US006675148B2

(12) United States Patent
Hardwick

(10) Patent No.: US 6,675,148 B2
(45) Date of Patent: Jan. 6, 2004

(54) LOSSLESS AUDIO CODER

(75) Inventor: John C. Hardwick, Sudbury, MA (US)

(73) Assignee: Digital Voice Systems, Inc., Burlington, MA (US)

( * ) Notice: Subject to any disclaimer, the term of this patent is extended or adjusted under 35 U.S.C. 154(b) by 524 days.

(21) Appl. No.: 09/754,090

(22) Filed: Jan. 5, 2001

(65) Prior Publication Data

US 2002/0147584 A1 Oct. 10, 2002

(51) Int. Cl.[7] ..... G10L 19/00
(52) U.S. Cl. ..... 704/500; 704/503
(58) Field of Search ..... 704/200, 500, 704/501, 502, 503, 504; 371/37.8, 30; 341/64, 67, 50, 51, 65, 107; 382/248

(56) References Cited

U.S. PATENT DOCUMENTS

| | | | | |
|---|---|---|---|---|
| 4,202,551 A | | 5/1980 | Darnall, Jr. | 274/34 |
| 4,225,142 A | | 9/1980 | Zolt | 274/39 |
| 4,425,813 A | | 1/1984 | Wadensten | 74/87 |
| 4,683,520 A | | 7/1987 | Grassens et al. | 361/427 |
| 4,705,257 A | | 11/1987 | Leo et al. | 248/611 |
| 4,812,932 A | | 3/1989 | Hishinuma et al. | 360/97.01 |
| 4,896,777 A | | 1/1990 | Lewis | 211/41 |
| 4,937,806 A | | 6/1990 | Babson et al. | 369/751 |
| 4,964,017 A | | 10/1990 | Jindrick et al. | 361/390 |
| 5,131,619 A | | 7/1992 | Daugherty et al. | 248/635 |
| 5,347,503 A | | 9/1994 | Koyama et al. | 369/44.32 |
| 5,402,308 A | | 3/1995 | Koyanagi et al. | 361/685 |
| 5,440,172 A | | 8/1995 | Sutrina | 257/712 |
| 5,737,304 A | | 4/1998 | Soga et al. | 369/247 |
| 5,839,100 A | | 11/1998 | Wegener | 704/220 |
| 5,860,726 A | | 1/1999 | Richardson | 362/35 |
| 5,875,067 A | | 2/1999 | Morris et al. | 360/97.01 |
| 5,884,269 A | * | 3/1999 | Cellier et al. | 704/501 |
| 5,943,208 A | | 8/1999 | Kato et al. | 361/685 |
| 5,956,314 A | | 9/1999 | Ishimatsu et al. | 369/247 |
| 6,021,041 A | | 2/2000 | Genix et al. | 361/685 |
| 6,041,302 A | | 3/2000 | Bruekers | 704/503 |
| 6,195,465 B1 | * | 2/2001 | Zandi et al. | 382/248 |
| 6,414,608 B1 | * | 7/2002 | Nishida et al. | 341/67 |

FOREIGN PATENT DOCUMENTS

| | | |
|---|---|---|
| EP | 0 442 642 A2 | 8/1991 |
| EP | 0 845 782 A1 | 6/1998 |
| EP | 0 874 175 A1 | 10/1998 |
| JP | 2001-283540 | 10/2001 |

OTHER PUBLICATIONS

T. Bell et al.; "Text Compression"; Chapter 8; Prentice Hall 1990.

Mat Hans; "Optimization of Digital Audio for Internet Transmission"; May 1998.

"Meridian Lossless Packaging Enabling High–Resolution Surround on DVD–Audio"; *Mix*; Dec. 1998.

Tony Robinson; "Shorten: Simple lossless and near–lossless waveform compression"; Dec. 1994.

* cited by examiner

*Primary Examiner*—Susan McFadden
(74) *Attorney, Agent, or Firm*—Fish & Richardson P.C.

(57) ABSTRACT

A lossless coding method may be used to compress information, such as audio data, without introducing any artifacts. This lossless coding method may be used to compress audio signals for use in storage and/or transmission of audio data. The audio data may be compressed by first dividing digital samples taken from the audio data into frames. A predictor is then used on the frames to generate prediction coefficients that can then be quantized to form predictor bits. The frames may then be subdivided into subsets. Another predictor can be used on the subsets to produce error samples that can be entropy coded into codeword bits. The predictor bits and codeword bits can be included in the compressed audio output for use in decoding.

60 Claims, 3 Drawing Sheets

LOSSLESS AUDIO CODER

TECHNICAL FIELD

This invention relates generally to the coding of audio signals and more particularly to a method of lossless compression of audio data for use in the transmission and/or storage of audio information.

BACKGROUND

Over the past ten to twenty years, the audio industry has seen a major transition from analog formats, such as cassette tapes, FM radio, and records to new digital formats such as the compact disc (CD), mini-disks (MD), digital versatile disks (DVD), and others. The widespread use of personal computers and the Internet has furthered this trend with the introduction of new electronic music services that allow electronic distribution of music and/or other audio content through a computer and the Internet. Many of these digital audio products and services use various audio compression technologies (e.g., MP3, Dolby AC3, ATRACS, MPEG-AAC, and Windows Media Player) to reduce the bit rate of audio transmissions to the range of 64–256 kbps from the 1440 kbps used on many uncompressed recordings, such as CDs, while maintaining a sufficient quality of high fidelity music reproduction. The use of compression technologies as well as the increased storage capacity of semiconductor (i.e., SRAM, DRAM, and Flash) devices and computer disks has made possible several new products including the RIO portable music player, the AudioRequest music jukebox, the Lansonic™ Digital Audio Server, and other devices.

In a typical digital audio application, an analog audio signal is sampled, for example, at 32, 44.1, or 48 kHz, and then is digitized with 16 or more bits using an analog-to-digital converter. If the audio source is a stereo source, then this process may be repeated for both the right and left channels. New surround sound audio may have six or more channels, each of which may be sampled and digitized. A typical CD contains two stereo channels, each of which is sampled at 44.1 kHz with 16 bits per sample, resulting in a data rate of approximately 1411.2 kbps. This allows storage of slightly more than 1 hour of music on a 650 MB CD. In a playback application, the digital music samples may be converted to an analog signal using a digital-to-analog converter, and then amplified and played through one or more speakers.

Several audio compression techniques may be used to compress a stereo music signal to the range of 64–256 kbps without significantly changing the quality of the audio signal (i.e., while maintaining CD-like quality). The MPEG-1 standard, developed and maintained by a working group of the International Standards Organization (ISO/IEC), describes three audio compression methods, referred to as Layers 1, 2, and 3, for reducing the bit rate of a digital audio signal. The method described under Layer 3, which is commonly known as MP3, is generally considered to achieve acceptable quality at 128 kbps and very good quality at 256 kbps.

These audio compression methods, as well as some other lossy techniques, use frequency domain coding techniques with a complex psychoacoustic model to discard portions of the audio signal that are considered inaudible. The techniques may be used to achieve near-CD quality at compression ratios of about, for example, 5-to-1 (256 kbps) or 11-to-1 (128 kbps). However, psychoacoustic modeling is an inexact process and some approaches may introduce artifacts into the audio signal that may be audible and annoying to some listeners. As a result, lossy compression may be less desirable in some applications requiring very high audio quality.

In the absence of any compression, the storage capacity of current consumer hard drives is quite limited. A large capacity hard drive, such as one with a capacity of 60–80 GB, can only store approximately 95–125 hours of uncompressed CD-quality music. In contrast, a CD changer may hold as many as 400 discs, providing over 400 hours of audio. As a result, some method of significantly increasing the amount of audio that can be stored on a hard drive without increasing cost or adding artifacts is useful.

One method of increasing the amount of data that can be stored is to compress the data before storing the data and then to expand the compressed data when needed. In lossy compression methods such as MP3, the expanded data differs slightly from the original data. For audio and video signals, this may be acceptable as long the differences are not too significant. However, for computer data, any difference may be unacceptable. As a result, lossless compression methods for which the expanded data are identical to the original uncompressed data have been developed. Various lossless or "entropy" coders attempt to remove redundancies from data (for example, after every "q" there is a "u") and exploit the unequal probability of certain types of data (for example, vowels occur more often than other letters). Computer programs such as "tar" and "ZIP" have been developed to perform lossless compression on documents and other computer files. These algorithms are typically based on methods developed by Ziv and Lempel or use other standard method such as Huffman coding or Arithmetic coding techniques (see, for example, T. Bell et. al., "Text Compression", Prentice-Hall, 1990).

Unfortunately, many lossless coding techniques designed for text or other computer-type data do not perform well on digital audio data. In fact, programs such as "ZIP" actually may enlarge an audio file rather than compressing the file. The problem is that these techniques assume certain features that may be common in text files but are not typically found in audio data.

Methods for lossless compression of audio typically attempt to compress an audio file by exploiting certain redundancies in the audio signal. Generally, these redundancies can be applied either in the time domain via prediction or in the frequency domain via bit allocation. In addition, entropy coding can be applied to take advantage of the varying probability of different data values by assigning shorter sequences of bits to represent higher probability values and longer sequences of bits to represent lower probability values. The result is a reduction in the average number of bits required to represent all of the data values. These advantages have resulted in the incorporation of lossless compression into the DVD-Audio format (see, "Meridian Lossless Packing Enabling High-Resolution Surround on DVD-Aduio", MIX, December 1998).

One technique for lossless compression is to divide the audio signal into segments or frames. Then, for each frame, to compute a low-order linear predictor that is quantized and stored for that frame. This predictor then may be applied to all the audio samples in the frame, and the prediction residuals (i.e., the error after prediction) may be coded using some form of entropy-type coder, such as, for example, a Huffman, Golomb, Rice, run-length, or arithmetic coder. In "Optimization of Digital Audio for Internet Transmission" (May 1998), Mat Hans describes the AudioPak lossless audio coder. This coder combines four low-order linear predictors (0, 1st, 2nd, and 3rd order), each having fixed prediction weights corresponding to known polynomials, with Golomb coding. Use of very low order predictors with fixed predictor weights results in a very simple algorithm with low complexity, but at the expense of lower prediction gain and larger file sizes.

In U.S. Pat. No. 5,839,100, Wegener describes a lossless audio coder that may be used in the MUSICompress system.

The Wegener method uses decimation (i.e., selection of every Nth sample) to implement non-linear time domain prediction of an audio signal which is combined with Huffman coding. Decimation introduces aliasing into the predicted signal whereby signal components at the same modulo N frequency are summed. This may distort the signal in a way that prevents accurate prediction of all frequency components, causing lower compression rates.

A paper titled, "SHORTEN: Simple lossless and near-lossless waveform compression", by Tony Robinson (December 1994) and U.S. Pat. No. 6,041,302 by Bruekers describe a lossless audio compression system using linear prediction and Rice coding. Rice coding is a form of Huffman coding optimized for Laplacian distributions. Rice codes form a family of codes parameterized by a single parameter "m" that can be adjusted to reasonably fit the statistics of the audio prediction residuals.

Prediction may be used to remove redundancy from the signal prior to coding in a lossless or a lossy system for coding audio signals. In a lossy speech coding application, modest (e.g., 8–14th) order adaptive linear predictors may be applied to each frame of speech (for example, 15–30 ms per frame) and predictor coefficients or weights may be computed using the autocorrelation or covariance methods. The predictor weights for this so-called "forward" predictor then may be quantized for passage to the decoder to form part of the side information for a frame. Many methods for efficient quantization of linear predictor coefficients have been devised, including transformation to partial correlation coefficients, reflection coefficients, or line spectral pairs, and using scalar and/or vector quantization.

Many low bit rate speech coders use forward prediction, where predictor coefficients are computed on data that has yet to be processed by the decoder, rather than backward prediction, where predictor coefficients are computed on data already processed by the decoder.

In a backward prediction system, data determining the prediction coefficients are known to both the encoder and decoder, which means that, usually, predictor coefficients are not quantized and extra side information bits are not used. Backward prediction systems that do not use extra bits may be adapted quite rapidly. However, they may be sensitive to bit errors or missing data, and, due to error feedback they may provide lower overall quality when used in low bit rate lossy speech coding. As a result, backward prediction is generally used only in higher bit rate (>=16 kbps) speech coding applications such as the ITU G.728 LD-CELP speech coding standard.

SUMMARY

In a first general aspect, lossless audio coding uses a combined forward and backward predictor for better approximation of an audio signal. Forward prediction is applied as a first stage and backward prediction is applied as a second stage. The overall prediction error is reduced, which results in smaller file sizes with lower complexity than when just forward prediction is used.

In another general aspect, an improved entropy coder more closely fits the statistics of the audio prediction residuals. A modified Golomb coder is parameterized by, for example, two parameters. An effective search procedure is used to find the best parameter values for each frame, resulting in more efficient entropy coding with smaller file sizes than previous techniques.

In one general aspect, digital samples that have been obtained from an audio signal are compressed into output bits that can be used, for example, to transmit and/or store the audio data. The digital samples are compressed by first dividing the samples into one or more frames, where each frame includes multiple samples. Each frame is compressed by computing a first predictor for the digital samples within the frame, with the first predictor being characterized by first prediction coefficients. Then, the first prediction coefficients are quantized to produce first predictor bits. The frames also are divided into one or more subsets, where each subset contains at least one of the digital samples. Next, a subset predictor is computed for a subset using digital samples contained in previous subsets. Error samples are produced using the first predictor bits and the subset predictor. These error samples are entropy coded to produce codeword bits. The first predictor bits and the codeword bits then are used in output bits for decompressing digital information.

Implementations may include one or more of the following features. For example, the first predictor may be a linear predictor, such as a first order linear predictor. Prediction coefficients may be quantized using scalar quantization for some or all of the prediction coefficients. The prediction coefficients also may be quantized using vector quantization. The first prediction coefficients may be computed by windowing digital samples to produce windowed samples. Autocorrelation coefficients may be computed from the windowed samples, and the first prediction coefficients may be computed by solving a system of linear equations using the autocorrelation coefficients.

A subset predictor may be used to compute prediction coefficients using only digital samples contained in previous subsets of the frame being computed.

The entropy coding of error samples to produce codeword bits may use at least one code parameter that determines the format of the codeword bit. The value of the code parameter may be encoded into one or more of the code parameter bits and included in the output bits. The code parameter bits may be determined by comparing two or more possible values of the code parameter and then encoding into the code parameter bits the value of the code parameter which is estimated to yield the smallest number of codeword bits. Also, the code parameter bits may be determined by entropy coding the error samples using two or more possible values of the code parameter and then encoding into the code parameter bits the value of the code parameter that yields the smallest number of codeword bits.

Error samples may be produced by first processing the digital samples using the first predictor to produce intermediate samples. The intermediate samples may be processed using the subset predictor to produce the error samples.

The output bits of the coder are such that they can be used with a suitable decoder to enable a substantially lossless reconstruction of the digital samples.

In one example, the frame contains 1152 digital samples which are divided into 48 subsets each containing 24 digital samples.

In another general aspect, compressing digital samples obtained from an audio source into output bits includes dividing the digital samples into frames, with each frame containing one or more of the digital samples. The digital samples then may be processed to produce error samples. These error samples may be entropy coded to produce codeword bits. The entropy coding uses at least a first code parameter and a second code parameter, with each code parameter varying from frame to frame. The codeword bits may be included in output bits.

Compressing digital samples may include using entropy coding that produces codeword bits as a combination of at least two terms. The first term may include a predetermined number of codeword bits, and the second term may include a variable number of codeword bits. The value of the first term may include information on the least significant bits of an error sample and/or information on the sign of the error sample. The number of codeword bits in the second term may be greater for an error sample with large magnitude and smaller for an error sample with small magnitude. The number of codeword bits in the first term may depend, at least in part, on the first code parameter, and the number of codeword bits in the second term may depend, at least in part, on the second code parameter.

The first code parameter for a frame may be encoded with the first code parameter bits, and the second code parameter for a frame may be encoded with the second code parameter bits. The first and second code parameter bits may be included in the output bits.

Error samples may be produced by computing one or more predictors for a frame and using the predictors to produce errors samples from the digital samples. The digital samples also may include first channel samples from a first channel of the audio source and second channel samples from a second channel of the audio source. The digital samples may be processed to produce error samples. The processing may include predicting the second channel samples from the first channels samples.

Error samples may be processed for a frame by computing a first predictor for the digital samples in a frame, with the first predictor having first prediction coefficients. The first prediction coefficients may be quantized to produce first predictor bits. The digital samples in a frame may be divided into one or more subsets. Each subset may contain one or more digital samples. A subset predictor may be computed for at least one of the subsets, using the digital samples contained in previous subsets. Error samples may be produced by processing the digital samples in a frame using both the first predictor and the subset predictor. The first predictor bits may be included in the output of the coder.

In another general aspect, audio data is reconstructed from output bits generated by an audio coder. Output bits, generated by an audio coder, are received and codeword bits, a first code parameter, a second code parameter, and predictor bits are obtained from the output bits. Error samples are reconstructed from the codeword bits using the first code parameter and the second code parameter. An error signal is computed from the reconstructed error samples. Error samples may be reconstructed by entropy decoding the codeword bits. Also, prediction coefficients are reconstructed using the predictor bits that were previously generated by quantizing the prediction coefficients.

The codeword bits may be a combination of at least two terms, including a first term that includes a predetermined number of codeword bits, and a second term including a variable number of codeword bits. The number of codeword bits in the second term may generally be greater for an error sample with large magnitude and generally smaller for an error sample with small magnitude. The value of the first term may include information on the least significant bits of an error sample.

The number of codeword bits in the first term may depend at least in part on the first code parameter and the number of codeword bits in the second term may depend at least in part on the second code parameter.

Audio data may be reconstructed using the prediction coefficients and the error samples by dividing the error samples for a frame into one or more subsets. Each subset may contain at least one of the error samples for the frame. A subset predictor is then computed for at least one of the subsets using information from previous subsets. The audio data may then be reconstructed using the prediction coefficients, the subset predictor, and the error samples.

The audio data may include first audio data for a first audio channel and second audio data for a second audio channel. In this case, audio data may be reconstructed by reconstructing the first audio data, and then reconstructing the second audio data using the first audio data.

Other features and advantages will be apparent from the description and drawings, and from the claims.

DETAILED DESCRIPTION

Figure 1:
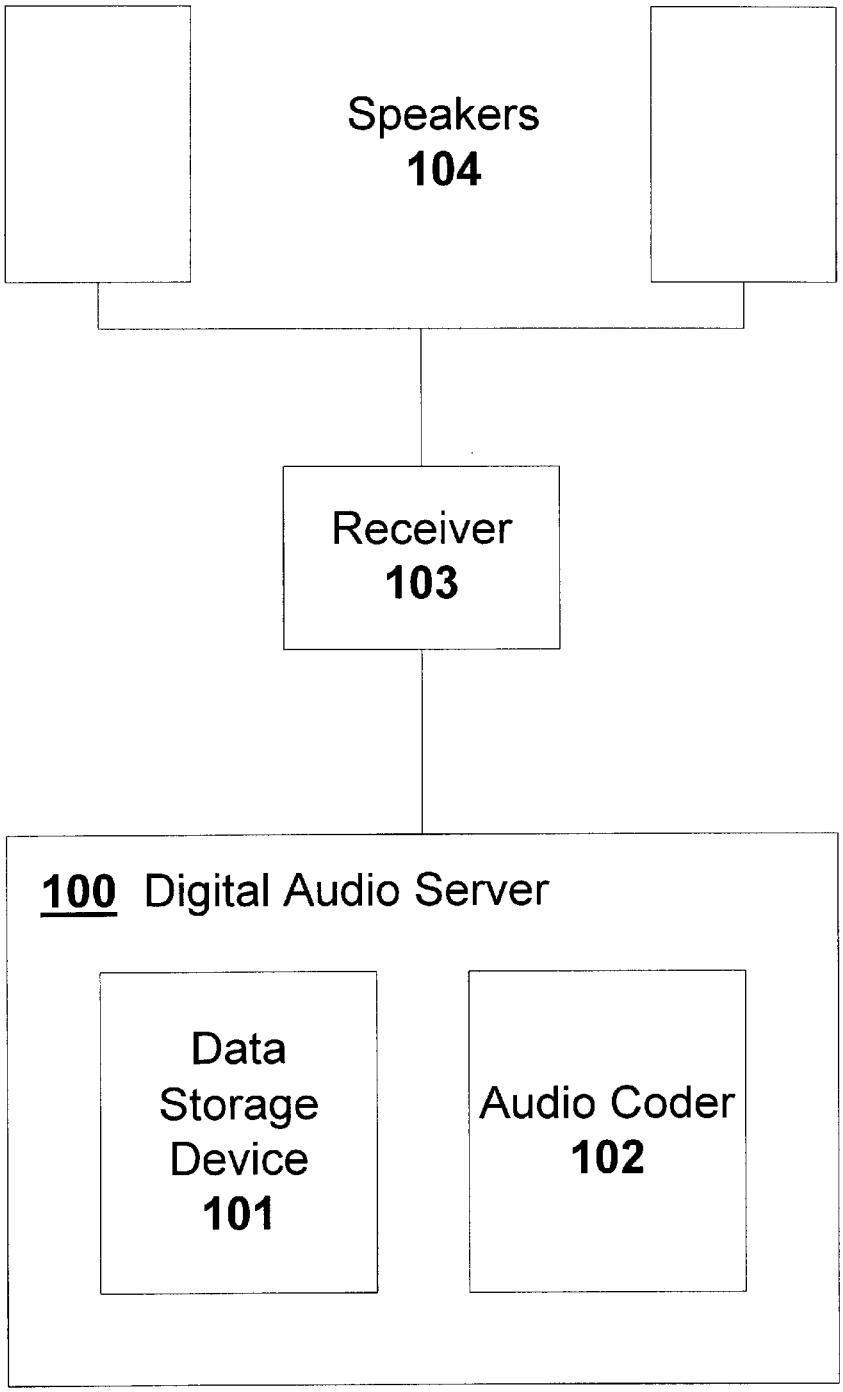
FIG. 1 is a block diagram of a digital audio server.

Referring to FIG. 1, a lossless audio coding system may be used in the transmission and/or storage of digital audio data. For example, lossless audio coding may be used to store CD-quality audio on a computer hard disk or other storage media. Lossless audio coding may be used to store audio data on a digital audio server device 100 containing a data storage device 101, such as, for example, one or more large (e.g., 20–80 GB) hard drives. The data may be coded and/or decoded using audio coder 102, which may be implemented either in hardware or software. For very high quality applications, lossy compression techniques may affect the playback quality of audio recordings. In such cases, lossless compression may be used to eliminate approximately half of the audio data, so as to allow twice the amount of audio data to be stored in data storage device 101 relative to the uncompressed audio found, for example, on a CD.

Digital audio server 100 is connected to a device for playing back the audio recording, such as receiver 103 connected to one or more speakers 104. Receiver 103 may be a standard stereo component receiver, such as a stereo receiver providing Dolby ProLogic or Dolby Digital decoding. Receiver 103 also may be implemented as a personal computer, a stereo amplifier, or any other audio playback device.

Figure 2:
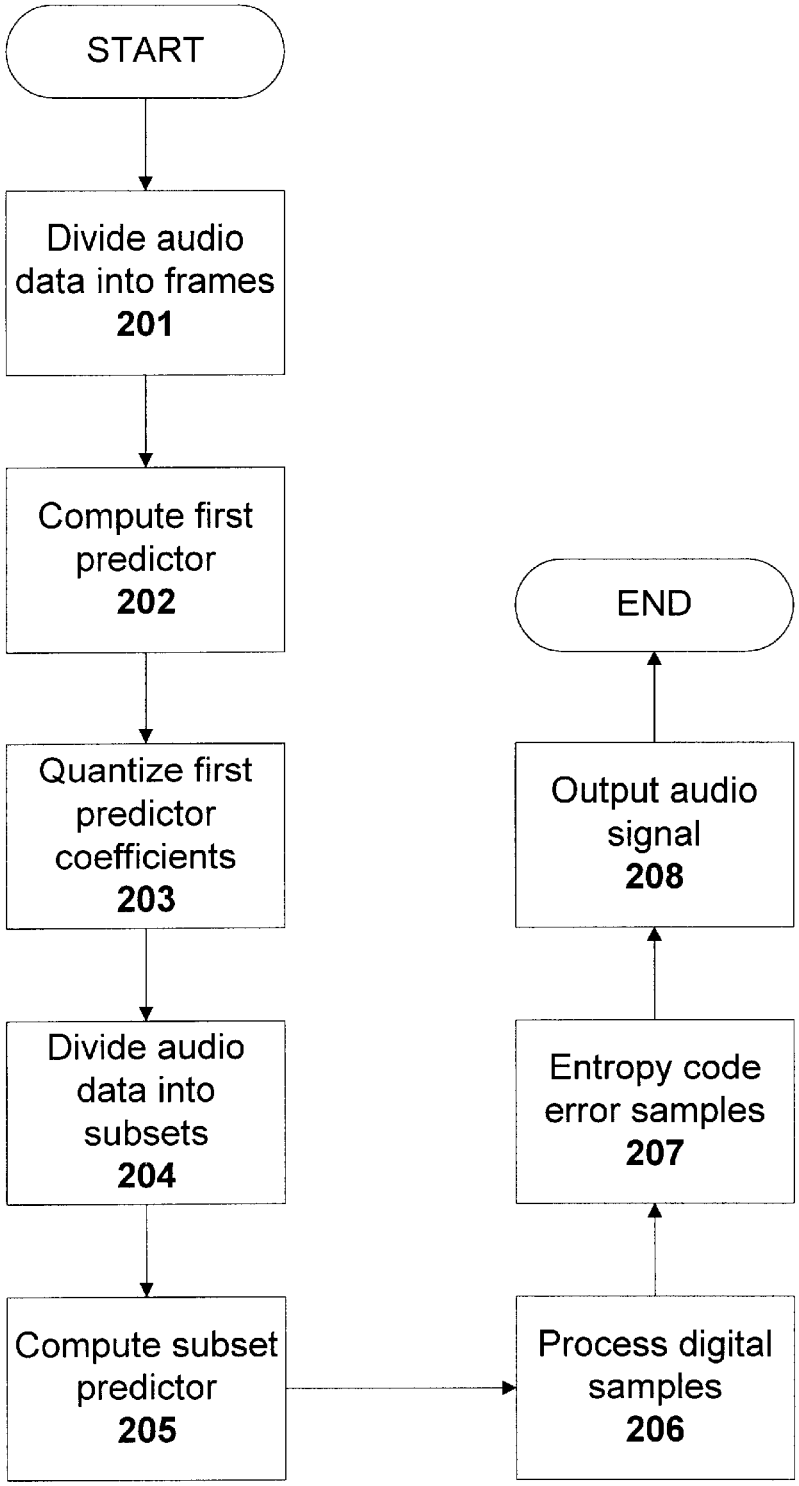
FIG. 2 is a flow chart of a procedure for compressing digital samples obtained from an audio signal.

Referring to FIG. 2, audio data may be compressed without loss by first dividing the audio data into small frames (step 201). For example, in one implementation, each frame includes N=1152 samples, which represents approximately 26.1 ms assuming a 44.1 kHz sampling rate. For multi-channel audio, all of the channels may be processed separately. However, for improved compression, interchannel prediction may be used for each additional channel beyond the first. For example, in the case of two-channel stereo audio, the first (i.e., the "right") channel, r(n), may be first compressed using the methods described below. The second (i.e., the "left") channel may be predicted from the first channel using interchannel processing to compute an interchannel prediction error signal el(n). This prediction error signal may then be further compressed using the techniques described below.

In the case of multi-channel audio, prediction of the second channel from the first typically uses a first order adaptive linear predictor $el(n)=l(n)-\rho*r(n)$, where the prediction coefficient, ρ, is computed as:

$$\rho = \frac{\sum l(n)r(n)}{\sum r^2(n)}. \tag{1}$$

Typically, the prediction coefficient, ρ, then is quantized using a quantizer, such as, for example, a 6-bit non-uniform quantizer such as is described in Appendix A. The output of this quantizer may be multiplexed with the other side information for the left channel and the left error signal, el(n), then may be compressed further using the prediction and entropy coding described below. This interchannel technique can be readily applied to applications with more than two channels, where each successive channel can be predicted from previous channels that have already been compressed. Also, higher order adaptive predictors can be used to account for more complex relationships between the channels.

Following any interchannel processing, a forward linear predictor may be computed for each channel for each frame of audio data (step 202) according to the following formula:

$$fe(n) = s(n) - \sum_{l=1}^{L} s(n-l)a(l), \quad \text{for } 0 \le n < N, \tag{2}$$

where s(n) is one channel of the audio signal for the frame and the order L of the forward predictor is typically less than or equal to 20 with smaller values of L used when lower complexity is desired.

The prediction coefficients a(l) for $1 \leqq l \leqq L$ can be computed using several methods. For example, the prediction coefficients may be computed using the standard autocorrelation method with a 1,728 point Kaiser window centered on the frame with Beta=4.0. Solving for the coefficients a(l) may be accomplished using the Levinson recursion method, and the computed coefficients may be converted into partial correlation (PARCOR) coefficients k(l) which have the property $|k(l)| \leqq 1$.

The values of k(l) for $1 \leqq l \leqq L$ are quantized (step 203) using a quantizer, such as, for example, the set of non-uniform scalar quantizers provided in Appendix B, with the number of bits for each quantizer given in Table 1. Note that other standard linear prediction quantization techniques using line spectral pairs (LSPs) or vector quantization may also be employed. The output of each of the L quantizers is normally included as part of the side information multiplexed into each frame of compressed data. Using L=20, the bit allocation in Table 1 produces 53 bits of side information per frame for each channel. Once the computed PARCOR coefficients are quantized, the quantized values may be converted back into prediction coefficients and used in accordance with Equation (2) to compute a forward prediction error, fe(n), for the frame. In this example, the quantized prediction coefficients are used to compute the prediction error, since only the quantized values are available to the decoder (via the side information) and for lossless decoding the decoder performs the exact inverse of this process using exactly the same prediction coefficients as the encoder.

TABLE 1

Bit Allocation for k(l), $1 \leqq l \leqq 20$

| l | Bit Allocation for k(l) |
|---|---|
| 0 | 5 |
| 1 | 5 |
| 2 | 4 |
| 3 | 4 |
| 4 | 4 |
| 5 | 4 |
| 6 | 4 |
| 7 | 3 |
| 8 | 3 |
| 9 | 3 |
| 10 | 3 |
| 11 | 3 |
| 12 | 2 |
| 13 | 2 |

TABLE 1-continued

Bit Allocation for k(l), $1 \leqq l \leqq 20$

| l | Bit Allocation for k(l) |
|---|---|
| 14 | 2 |
| 15 | 2 |
| 16 | 2 |
| 17 | 2 |
| 18 | 2 |
| 19 | 2 |

Once the forward prediction residuals are computed for the frame, a backward predictor may be used to operate on the forward prediction error fe(n). For the backward predictor, the frame is divided into small subframes (step 204) of, for example, 24 samples each. For the jth subframe, the backward prediction error be(n) is generally computed as:

$$be(n) = fe(n) - \sum_{i=1}^{I} b(j-1)(i) \cdot fe(n-i), \quad \text{for } j \cdot 24 \le n < (j+1) \cdot 24. \tag{3}$$

The backward prediction coefficients b(j−1)(i) are updated (step 205) at the end of each subframe using data computed from that subframe and prior subframes within the frame. In one implementation, a lossless audio coder having I=1 and a first order back predictor be(n)=fe(n)−b(j−1)(1) *fe(n−1) are applied (step 206), and the backward prediction coefficents b(j)(1) are updated as follows:

$$b(j)(1) = \left(\frac{1}{2}\right) b(j-1)(1) + \frac{\sum_{n=0}^{24} fe(24j+n) \cdot fe(24j+n-1)}{2 \cdot \sum_{n=0}^{24} fe^2(j*24+n)}. \tag{4}$$

The first subframe in the frame b(−1)(1) is initialized to a known constant, for example 0.375, and fe(−1) is initialized to zero. Initialization in this manner insures that the backward predictor only depends on data from the current frame rather than from previous frames. This significantly reduces sensitivity to bit errors and eliminates problems from missing data in previous frames. Furthermore, it allows the method to be used in streaming or broadcast applications where the receiver may start receiving some time after transmission begins and hence may not receive the beginning of the signal.

The backward prediction error be(n) for $0 \leqq n < N$ is entropy coded (step 207) using a modified Golomb code. The original audio signal s(n) is typically integer valued and typically both the forward and backward prediction are done with integer arithmetic to reduce numerical sensitivity and to ensure that be(n) also has integer values. The modified Golomb code first maps the signed values of be(n) to a non-negative sequence p(n) as follows:

$$p(n)=be(n), \text{ if } be(n)=0,$$

$$p(n)=2 \cdot be(n)-1, \text{ if } be(n)>0,$$

and $$p(n)=-2 \cdot be(n), \text{ if } be(n)<0. \tag{5}$$

Note that due to the one-to-one mapping, there is a similar inverse mapping to recover the values of be(n) from p(n).

The entropy coding of p(n) is performed by first separating p(n) into two terms, with the first term (A=p(n) mod M) representing the least significant M bits of p(n), the second term (B=⌊p(n)/M ⌋) representing the remaining most significant bits, and the parameter M being a first parameter of the code.

The first term, A, generally represent the least significant bits and the sign of be(n), while the second term, B, generally represents the most significant bits of be(n). The codeword corresponding to p(n) is produced by combining the two terms, using M bits to write A, followed by a variable number of bits to write B. The number of bits used to write A is predetermined and equal to the first code parameter M. Encoding of the variable sized term B is accomplished using Z zeros, followed by a 1, followed by X auxiliary bits, where the number of zeros, Z, and the number of auxiliary bits, X, are dependent on the value of B.

In one implementation, the dependence on B of X and Z is given by the following equations:

$$X=1, \text{ if } B<2T,$$

$$X=0, \tag{6}$$

otherwise, and $$Z=\lfloor B/2 \rfloor, \text{ if } B<2T,$$

$$Z=B-T, \tag{7}$$

otherwise, where T is a second parameter of the code. Each value of B is mapped to a unique combination of the number of zeros, Z, and of the X auxiliary bits, which preferably is set equal to the X least significant bits of B, whenever B<2T.

Table 2 shows exemplary encodings of B for different values of T, following the above procedure.

TABLE 2

Example Encodings of B for various T

| B | T = 0 | T = 1 | T = 2 | T = 3 |
|---|---|---|---|---|
| 0 | 1 | 10 | 10 | 10 |
| 1 | 01 | 11 | 11 | 11 |
| 2 | 001 | 01 | 010 | 010 |
| 3 | 0001 | 001 | 011 | 011 |
| 4 | 00001 | 0001 | 001 | 0010 |
| 5 | 000001 | 00001 | 0001 | 0011 |
| 6 | 0000001 | 000001 | 00001 | 0001 |
| 7 | 00000001 | 0000001 | 000001 | 00001 |
| 8 | 000000001 | 00000001 | 0000001 | 000001 |
| 9 | 0000000001 | 000000001 | 00000001 | 0000001 |
| 10 | 00000000001 | 0000000001 | 000000001 | 00000001 |
| 11 | 000000000001 | 00000000001 | 0000000001 | 000000001 |
| 12 | 0000000000001 | 000000000001 | 00000000001 | 0000000001 |
| 13 | 00000000000001 | 0000000000001 | 000000000001 | 00000000001 |
| 14 | 000000000000001 | 00000000000001 | 0000000000001 | 000000000001 |
| 15 | 0000000000000001 | 000000000000001 | 00000000000001 | 0000000000001 |

Note that many other useful relationships between Z, X, and B can be formulated to allow further adaptability of the code. For example, Equation (6) can be generalized using a sequence of parameters (T0, T1, T2, . . . ) with a corresponding number of auxiliary bits (X0, X1, X2, . . . ) used for the respective conditions (Z<T0, T0≦Z<T1, T1≦Z<T2, . . . ). In this case, Equation (7) and the values of the auxiliary bits are modified in a straightforward manner to maintain a unique mapping for each value of B.

This implementation of lossless audio encoding provides adaptability in the selection of the code parameters M and T. While it is possible to fix M and/or T, compression may be improved by selecting one or more new values of M and/or T for each frame, where the selection is made in a manner to reduce the total number of bits required to represent some or all of the codewords for that frame. M and T may be selected by encoding p(n) with all the combinations of M and T in some limited range, and by selecting the combination which yields the smallest number of encoded bits. Typically, the selected values of M and T are encoded using 4 bits for M (0≦M<16) and 2 bits for T (0≦T<4), which yields a total of 64 combinations. However, in practice only a few of these combinations actually need to be tried. The selection of M may be limited to a small range (typically +/−1) around an initial estimate computed as: M0=$\log_2[\log(2)\ E(|be(n)|)]$, where the expected value E(|be(n)|) is approximated according to the standard formula:

$$E(|be(n)|) = \frac{1}{N \sum_{n=0}^{N-1} |be(n)|}. \tag{8}$$

Searching all combinations of T for the each of the values of M in a small range near M0 produces virtually the same degree of compression as searching all combinations of M and T, with the added advantage that the partial search is much less complex. It is also possible to further analyze the data to limit the searches in T, and experiments have shown that even with fixed T=1, the performance of the modified Golomb code produces better compression than the standard Golomb code.

For each audio channel, the encoder generates output data (step 208) that may include side information representing the quantized forward predictor (43 bits), the selected value of M (4 bits), and the selected value of T (2 bits), plus the modified Golomb encoded codewords for all N samples of be(n). In the case of multichannel audio (e.g., two channel stereo or five channel Dolby Digital surround sound), these data are output for each channel. However, the side information for the second channel as well as any additional channels beyond the second may include a quantized interchannel predictor (6 bits) as described previously.

Figure 3:
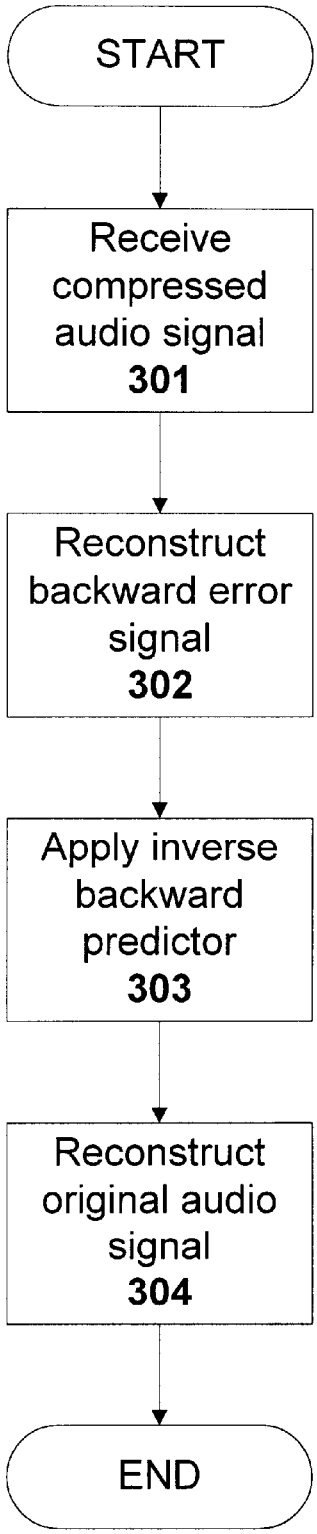
FIG. 3 is a flow chart of a procedure for decompressing a digital signal that has been compressed using a lossless audio coder.

Referring to FIG. 3, a corresponding decoder may be used to reconstruct the original audio data from the encoded representation produced by the encoder (step 301). The decoder operates by reconstructing from the modified Golomb codewords the backward error signal, be(n), for each channel using the values of M and T carried in the side information for that frame (step 302). The backward error signal then may be passed through an inverse backward predictor (step 303), for example, fe(n)=be(n)+b(j−1)(1)*fe(n−1) to compute the forward error signal fe(n), where the first order backward predictor b(j)(1) is initialized and updated for each subframe using Equation (4) in the same manner as the encoder. The original audio signal s(n) is likewise reconstructed (step 304) from the forward error signal fe(n) according to the following equation:

$$s(n) = fe(n) + \sum_{l=1}^{L} s(n-l) \cdot a(l) \tag{9}$$

where the forward prediction coefficients, a(l), are reconstructed from the side information for that frame. In the case of multichannel audio, any interchannel prediction applied by the encoder is inverted in a similar manner by the decoder to reconstruct the final audio signal.

Note that while this system provides lossless compression of audio data, it can also be used for very high quality lossy compression. In one method for lossy encoding of audio data, an extra optional shift factor, S, is applied to the backward error signal be(n). The shift factor in set according to the following rule:

$$S=M-Ms,\ M>Ms, \text{ and}$$

$$S=0, \tag{10}$$

otherwise, where the threshold, Ms, is determined by the amount of "loss" that is acceptable.

The shift factor is applied by shifting out the S least significant bits of be(n) prior to Golomb encoding. In the decoder this procedure is reversed by shifting be(n) up by S bits and adding $2^{(S-1)}$ prior to performing the inverse prediction. The result of these steps is that, whenever M>Ms, some of the least significant bits are discarded prior to encoding and hence the decoded audio is not exactly the same as the original audio data. However, since the effect is primarily limited to the least significant and hence less audible part of the audio signal, high quality audio can still be achieved with compression rates of 3–5 times.

Other implementations are within the scope of the following claims.

APPENDIX A

6 Bit Non-Uniform Quantizer for First Order Interchannel Predictor

| Index | Quantizer Value |
|---|---|
| 0 | −.034098 |
| 1 | 4.3069 |
| 2 | .6006 |
| 3 | .2916 |
| 4 | .4471 |
| 5 | −.2574 |
| 6 | .3884 |
| 7 | .3300 |
| 8 | .3964 |
| 9 | .4335 |
| 10 | .002889 |
| 11 | .1888 |
| 12 | .2311 |
| 13 | .1562 |
| 14 | 1.000 |
| 15 | .6174 |
| 16 | .5519 |
| 17 | .4639 |
| 18 | .1460 |
| 19 | .3493 |

APPENDIX A-continued

6 Bit Non-Uniform Quantizer for First Order Interchannel Predictor

| Index | Quantizer Value |
|---|---|
| 20 | .05874 |
| 21 | .2778 |
| 22 | .07971 |
| 23 | .4811 |
| 24 | .03375 |
| 25 | .4224 |
| 26 | −.3877 |
| 27 | .2161 |
| 28 | .1768 |
| 29 | −.1597 |
| 30 | −2.208 |
| 31 | .2617 |
| 32 | .4998 |
| 33 | .09689 |
| 34 | .1659 |
| 35 | 12.670 |
| 36 | −.8778 |
| 37 | .1237 |
| 38 | .3599 |
| 39 | .3049 |
| 40 | .3397 |
| 41 | −1.3362 |
| 42 | .2021 |
| 43 | .5838 |
| 44 | .6657 |
| 45 | .3703 |
| 46 | .1354 |
| 47 | −.5783 |
| 48 | .4046 |
| 49 | .3184 |
| 50 | .3800 |
| 51 | .5346 |
| 52 | −.08667 |
| 53 | .8520 |
| 54 | 1.4828 |
| 55 | .5678 |
| 56 | .5178 |
| 57 | .1111 |
| 58 | .2465 |
| 59 | .6389 |
| 60 | 2.578 |
| 61 | .7591 |
| 62 | .7038 |
| 63 | .4130 |

APPENDIX B

Non-Uniform Scalar Quantizers for Forward Predictor

| Index | Quantizer Value |
|---|---|
| B.0 5 bit quantizer for 1 = 0 | |
| 0 | .9659939 |
| 1 | .9988664 |
| 2 | .9994784 |
| 3 | .9966566 |
| 4 | .9844495 |
| 5 | .9938794 |
| 6 | .9957781 |
| 7 | .9948506 |
| 8 | .9974933 |
| 9 | .8643624 |
| 10 | .9861720 |
| 11 | .9891772 |
| 12 | .9982287 |
| 13 | .9928406 |
| 14 | .9703388 |
| 15 | .9600936 |
| 16 | .9522324 |
| 17 | .7419546 |
| 18 | .9877445 |

APPENDIX B-continued

Non-Uniform Scalar Quantizers for Forward Predictor

| Index | Quantizer Value |
|---|---|
| 19 | .9787532 |
| 20 | .8137161 |
| 21 | .9904836 |
| 22 | .9413784 |
| 23 | .9826772 |
| 24 | .6393074 |
| 25 | .9009055 |
| 26 | .9917094 |
| 27 | .9736391 |
| 28 | .9807975 |
| 29 | .9253348 |
| 30 | .9764101 |
| 31 | 0.0 |
| B.1 5 bit quantizer for l = 1 | |
| 0 | −.7524270 |
| 1 | −.9877042 |
| 2 | −.9736536 |
| 3 | −.7293493 |
| 4 | −.9621547 |
| 5 | −.9486010 |
| 6 | −.6779138 |
| 7 | −.05932157 |
| 8 | −.4678430 |
| 9 | −.6221167 |
| 10 | .1635733 |
| 11 | −.8139132 |
| 12 | .5402579 |
| 13 | −.8317617 |
| 14 | −.5134417 |
| 15 | −.1681219 |
| 16 | −.9656837, |
| 17 | −.9157286, |
| 18 | −.5536591, |
| 19 | −.6512799, |
| 20 | −.5893744, |
| 21 | −.8826373, |
| 22 | −.8994818, |
| 23 | −.7947098, |
| 24 | −.8488274, |
| 25 | .04328764, |
| 26 | −.3463203, |
| 27 | −.9319999, |
| 28 | −.7044382, |
| 29 | −.7741293, |
| 30 | −.4145659, |
| 31 | −.2639911 |
| B.2 4 bit quantizer for l = 2 | |
| 0 | .08794872 |
| 1 | −.7750393 |
| 2 | .8766201 |
| 3 | −.4662539 |
| 4 | .1922842 |
| 5 | .2760510 |
| 6 | .5111743 |
| 7 | .4010011 |
| 8 | −.04721336 |
| 9 | .7018681 |
| 10 | .4557702 |
| 11 | .6305268 |
| 12 | .5684454 |
| 13 | .3428863 |
| 14 | −.2381265 |
| 15 | .7875859 |
| B.3 4 bit quantizer for l = 3 | |
| 0 | .5710726 |
| 1 | .3914019 |
| 2 | .2692767 |
| 3 | −.5202016 |
| 4 | −.6868389 |
| 5 | .05093540 |
| 6 | .1541075 |
| 7 | −.5872226 |

APPENDIX B-continued

Non-Uniform Scalar Quantizers for Forward Predictor

| Index | Quantizer Value |
|---|---|
| 8 | −.4621386 |
| 9 | −.3001415 |
| 10 | −.4070184 |
| 11 | −.3537728 |
| 12 | −.1188258 |
| 13 | −.2453600 |
| 14 | −.03932683 |
| 15 | −.1856052 |
| B.4 4 bit quantizer for l = 4 | |
| 0 | .2103013 |
| 1 | .3083340 |
| 2 | −.2522253 |
| 3 | −.3438762 |
| 4 | .1660577 |
| 5 | .1231071 |
| 6 | −.06150698 |
| 7 | .5417671 |
| 8 | .4428142 |
| 9 | .03734619 |
| 10 | .3694975 |
| 11 | −.1822241 |
| 12 | −.008753308 |
| 13 | −.1201142 |
| 14 | .08071340 |
| 15 | .2568181 |
| B.5 4 bit quantizer for l = 5 | |
| 0 | .2145806 |
| 1 | .3402392 |
| 2 | −.4227384 |
| 3 | −.2322869 |
| 4 | −.4904339 |
| 5 | −.003712975 |
| 6 | .05283693 |
| 7 | −.3174772 |
| 8 | −.04884965 |
| 9 | −.1957825 |
| 10 | −.08868919 |
| 11 | −.3676099 |
| 12 | .1259245 |
| 13 | −.2721864 |
| 14 | −.1252577 |
| 15 | −.1603424 |
| B.6 4 bit quantizer for l = 6 | |
| 0 | −.2597265 |
| 1 | .4115449 |
| 2 | .04184072 |
| 3 | .1215950 |
| 4 | −.1584679 |
| 5 | −.08816823 |
| 6 | .09694316 |
| 7 | .3345242 |
| 8 | .2325162 |
| 9 | .7098457 |
| 10 | .2757551 |
| 11 | .1983530 |
| 12 | .1698541 |
| 13 | −.03445147 |
| 14 | .1447476 |
| 15 | .008154644 |
| B.7 3 bit quantizer for l = 7 | |
| 0 | −.2344300 |
| 1 | .1676646 |
| 2 | −.3189372 |
| 3 | −.06671936 |
| 4 | .06891654 |
| 5 | −.1751942 |
| 6 | −.1213538 |
| 7 | −.004475277 |

APPENDIX B-continued

Non-Uniform Scalar Quantizers for Forward Predictor

| Index | Quantizer Value |
|---|---|
| B.8 3 bit quantizer for l = 8 | |
| 0 | −.0002137973 |
| 1 | .2196834 |
| 2 | −.1621969 |
| 3 | .3084771 |
| 4 | .05321136 |
| 5 | .1032912 |
| 6 | .1563970 |
| 7 | −.06488300 |
| B.9 3 bit quantizer for l = 9 | |
| 0 | .1548602 |
| 1 | −.2440517 |
| 2 | −.1341489 |
| 3 | −.08104721 |
| 4 | .05495924 |
| 5 | −.02045774 |
| 6 | −.1851722 |
| 7 | −.3300617 |
| B.10 3 bit quantizer for l = 10 | |
| 0 | .2625484 |
| 1 | −.1808913 |
| 2 | .07588041 |
| 3 | .1246535 |
| 4 | .1824803 |
| 5 | .02915521 |
| 6 | −.08648710 |
| 7 | −.02223778 |
| B.11 3 bit quantizer for l = 11 | |
| 0 | .1249600 |
| 1 | −.2839665 |
| 2 | −.01346401 |
| 3 | −.06213566 |
| 4 | −.2080165 |
| 5 | −.1078273 |
| 6 | −.1540408 |
| 7 | .04275909 |
| B.12 2 bit quantizer for l = 12 | |
| 0 | .2042079 |
| 1 | −.06843125 |
| 2 | .1106078 |
| 3 | .03018990 |
| B.13 2 bit quantizer for l = 13 | |
| 0 | .06919591 |
| 1 | −.2225718 |
| 2 | −.1256930 |
| 3 | −.03975704 |
| B.14 2 bit quantizer for l = 14 | |
| 0 | .1046253 |
| 1 | .02314145 |
| 2 | .1954758 |
| 3 | −.07630695 |
| B.15 2 bit quantizer for l = 15 | |
| 0 | −.1410635 |
| 1 | −.05384010 |
| 2 | −.2418302 |
| 3 | .0497693 |
| B.16 2 bit quantizer for l = 16 | |
| 0 | .1046253 |
| 1 | .02314145 |
| 2 | .1954758 |
| 3 | −.07630695 |
| B.17 2 bit quantizer for l = 17 | |
| 0 | −.1410635 |
| 1 | −.05384010 |

APPENDIX B-continued

Non-Uniform Scalar Quantizers for Forward Predictor

| Index | Quantizer Value |
|---|---|
| 2 | −.2418302 |
| 3 | .0497693 |
| B.18 2 bit quantizer for l = 18 | |
| 0 | .1046253 |
| 1 | .02314145 |
| 2 | .1954758 |
| 3 | −.07630695 |
| B.19 2 bit quantizer for l = 19 | |
| 0 | −.1410635 |
| 1 | −.05384010 |
| 2 | −.2418302 |
| 3 | .0497693 |

What is claimed is:

1. A method of compressing digital samples obtained from an audio signal into output bits, the method comprising:

dividing the digital samples into one or more frames, each frame including multiple digital samples;

computing a first predictor for the digital samples in a frame, wherein the first predictor is characterized by first prediction coefficients;

quantizing the first prediction coefficients to produce first predictor bits;

dividing the digital samples in a frame into one or more subsets, each subset containing at least one of the digital samples in the frame;

computing a subset predictor for at least one of the subsets, wherein the subset predictor is computed using digital samples contained in previous subsets;

processing the digital samples for the at least one of the subsets using both the first predictor bits and the subset predictor to produce error samples;

entropy coding the error samples to produce codewords bits; and including the first predictor bits and the codeword bits in the output bits.

2. The method of claim 1 wherein quantizing of the first set of prediction coefficients to produce first predictor bits comprises using scalar quantization for at least one of the prediction coefficients.

3. The method of claim 1 or 2 wherein quantizing of the first set of prediction coefficients to produce first predictor bits uses vector quantization for at least some of the prediction coefficients.

4. The method of claim 2 wherein the subset predictor comprises a first order linear predictor.

5. The method of claim 1 wherein computing the subset predictor comprises using only the digital samples contained in previous subsets of the frame containing the subset for which the subset predictor is being computed.

6. The method of claim 1 wherein the first predictor comprises a linear predictor.

7. The method of claim 6, wherein computing the first prediction coefficients comprises:

windowing the digital samples to produce windowed samples;

computing autocorrelation coefficients from said windowed samples; and solving a system of linear equations using the autocorrelation coefficients to produce the first prediction coefficients.

8. The method of claim 1 wherein the entropy coding is characterized by at least one code parameter that determines a format of the codeword bits produced by the entropy coding.

9. The method of claim 8 wherein a value of the code parameter is encoded into one or more code parameter bits that are included in the output bits.

10. The method of claim 9 wherein the code parameter bits are determined by comparing two or more possible values of the code parameter and then encoding into the code parameter bits the value of the code parameter which is estimated to yield the smallest number of codeword bits.

11. The method of claim 9 wherein the code parameter bits are determined by entropy coding the error samples using two or more possible values of the code parameter and then encoding into the code parameter bits the value of the code parameter which yields the smallest number of codeword bits.

12. The method of claim 1 wherein the error samples are produced by first processing the digital samples using the first predictor to produce intermediate samples followed by processing the intermediate samples using the subset predictor to produce the error samples.

13. The method of claims 1, 7, 8, or 9 wherein the output bits are characterized in that they can be used with a suitable decoder to enable a substantially lossless reconstruction of the digital samples.

14. The method of claims 4 or 9 wherein the frame contains 1152 digital samples divided into 48 subsets that each contain 24 digital samples.

15. A method of compressing digital samples obtained from an audio source into output bits, the method comprising:

dividing the digital samples into frames, each frame including at least one of the digital samples;

processing the digital samples to produce error samples;

entropy coding the error samples to produce codewords bits, wherein the entropy coding is characterized by at least a first code parameter and a second code parameter, the first code parameter and the second code parameter being variable from frame to frame; and including the codeword bits in the output bits.

16. The method of claim 15 wherein the entropy coding produces codeword bits as a combination of at least two terms, including a first term comprising a predetermined number of codeword bits, and a second term comprising a variable number of codeword bits.

17. The method of claim 16 wherein the value of the first term includes information on the least significant bits of an error sample.

18. The method of claims 16 or 17 wherein the value of the first term includes information on the sign of an error sample.

19. The method of claim 16 wherein the number of codeword bits in the second term is generally greater for an error sample with large magnitude and generally smaller for an error sample with small magnitude.

20. The method of claims 16 or 19 wherein:

the number of codeword bits in the first term depends at least in part on the first code parameter, and the number of codeword bits in the second term depends at least in part on the second code parameter.

21. The method of claims 15 or 16 wherein:

the first code parameter for a frame is encoded with first code parameter bits, the second code parameter for a frame is encoded with second code parameter bits, and the first code parameter bits and the second code parameter bits are included in the output bits.

22. The method of claims 15 or 16 wherein processing of digital samples to produce error samples includes computing one or more predictors for a frame and using the predictors to produce errors samples from the digital samples.

23. The method of claim 22 wherein:

the digital samples include first channel samples from a first channel of the audio source and second channel samples from a second channel of the audio source, and processing of digital samples to produce error samples includes predicting the second channel samples from the first channel samples.

24. The method of claims 15 or 16 wherein the processing of digital samples in a frame to produce error samples includes:

computing a first predictor for the digital samples in a frame, the first predictor being characterized by first prediction coefficients;

quantizing the first prediction coefficients to produce first predictor bits;

dividing the digital samples in a frame into one or more subsets, each subset containing at least one of the digital samples in the frame;

computing a subset predictor for at least one of the subsets, wherein the subset predictor is computed using only the digital samples contained in previous subsets;

processing the digital samples in a frame using both the first predictor and the subset predictor to produce error samples; and including the first predictor bits in the output bits.

25. A device configured to compress digital samples obtained from an audio signal into output bits, the device comprising:

an input unit configured to receive digital samples obtained from an audio signal; and a processor connected to the input unit to receive the digital samples, the processor being configured to:

divide the digital samples into one or more frames, each frame including multiple digital samples;

compute a first predictor for the digital samples in a frame, the first predictor being characterized by first prediction coefficients;

quantize the first prediction coefficients to produce first predictor bits;

divide the digital samples in a frame into one or more subsets, with each subset containing at least one of the digital samples in the frame;

compute a subset predictor for at least one of the subsets using digital samples contained in previous subsets;

process the digital samples for the at least one of the subsets using both the first predictor bits and the subset predictor to produce error samples;

entropy code the error samples to produce codewords bits; and produce output bits including the first predictor bits and the codeword bits.

26. The device of claim 25 wherein the processor is configured to quantize the first set of prediction coefficients to produce first predictor bits using scalar quantization for at least one of the prediction coefficients.

27. The device of claim 25 or 26 wherein the processor is configured to quantize the first set of prediction coefficients to produce first predictor bits using vector quantization for at least some of the prediction coefficients.

28. The device of claim 26 wherein the subset predictor comprises a first order linear predictor.

29. The device of claim 25 wherein the processor is configured to compute the subset predictor using only the digital samples contained in previous subsets of the frame containing the subset for which the subset predictor is being computed.

30. The device of claim 25 wherein the first predictor comprises a linear predictor.

31. The device of claim 30, wherein the processor is configured to compute the first prediction coefficients by:

windowing the digital samples to produce windowed samples;

computing autocorrelation coefficients from said windowed samples; and solving a system of linear equations using the autocorrelation coefficients to produce the first prediction coefficients.

32. The device of claim 25 wherein the processor is configured to determine a format of the codeword bits produced by the entropy coding using an entropy coding parameter.

33. The device of claim 32 wherein the processor is configured to encode a value of the code parameter into one or more code parameter bits and to include the code parameter bits in the output bits.

34. The device of claim 33 wherein the processor is configured to determine the code parameter bits by comparing two or more possible values of the code parameter and then encoding into the code parameter bits the value of the code parameter which is estimated to yield the smallest number of codeword bits.

35. The device of claim 33 wherein the processor is configured to determine the code parameter bits by entropy coding the error samples using two or more possible values of the code parameter and then encoding into the code parameter bits the value of the code parameter which yields the smallest number of codeword bits.

36. The device of claim 25 wherein the processor is configured to produce the error samples by first processing the digital samples using the first predictor to produce intermediate samples followed by processing the intermediate samples using the subset predictor to produce the error samples.

37. The device of claim 25 wherein the output bits are characterized in that they can be used with a suitable decoder to enable a substantially lossless reconstruction of the digital samples.

38. A device configured to compress digital samples obtained from an audio source into output bits, the device comprising:

an input unit configured to receive digital samples obtained from an audio signal; and a processor connected to the input unit to receive the digital samples, the processor being configured to:

divide the digital samples into frames, each frame including at least one of the digital samples;

process the digital samples to produce error samples;

entropy code the error samples to produce codewords bits, the entropy coding being characterized by at least a first code parameter and a second code parameter, the first code parameter and the second code parameter being variable from frame to frame; and produce output bits including the codeword bits.

39. The device of claim 38 wherein the processor is configured to entropy code the error samples to produce codeword bits as a combination of at least two terms, including a first term comprising a predetermined number of codeword bits, and a second term comprising a variable number of codeword bits.

40. The device of claim 39 wherein the value of the first term includes information on the least significant bits of an error sample.

41. The device of claims 39 or 40 wherein the value of the first term includes information on the sign of an error sample.

42. The device of claim 39 wherein the number of codeword bits in the second term is greater for an error sample with large magnitude and smaller for an error sample with small magnitude.

43. The device of claims 39 or 42 wherein:

the number of codeword bits in the first term depends at least in part on the first code parameter, and the number of codeword bits in the second term depends at least in part on the second code parameter.

44. The device of claims 38 or 39 wherein:

the first code parameter for a frame is encoded with first code parameter bits, the second code parameter for a frame is encoded with second code parameter bits, and the first code parameter bits and the second code parameter bits are included in the output bits.

45. The device of claims 38 or 39 wherein the processor is configured to process the digital samples to produce error samples by computing one or more predictors for a frame and using the predictors to produce errors samples from the digital samples.

46. The device of claim 45 wherein:

digital samples include first channel samples from a first channel of the audio source and second channel samples from a second channel of the audio source, and the processor is configured to process digital samples to produce error samples by predicting the second channel samples from the first channel samples.

47. The device of claims 38 or 39 wherein the processor is configured to process digital samples to produce error samples by:

computing a first predictor for the digital samples in a frame, the first predictor being characterized by first prediction coefficients;

quantizing the first prediction coefficients to produce first predictor bits;

dividing the digital samples in a frame into one or more subsets, each subset containing at least one of the digital samples in the frame;

computing a subset predictor for at least one of the subsets, wherein the subset predictor is computed using only the digital samples contained in previous subsets;

processing the digital samples in a frame using both the first predictor and the subset predictor to produce error samples; and including the first predictor bits in the output bits.

48. A method of reconstructing audio data from output bits generated by an audio coder, the method comprising:

receiving the output bits generated by the audio coder;

obtaining codeword bits, a first code parameter, a second code parameter, and predictor bits from the output bits;

reconstructing error samples from the codeword bits using the first code parameter and the second code parameter;

reconstructing prediction coefficients using the predictor bits, wherein the predictor bits were previously generated by quantizing the prediction coefficients; and reconstructing audio data using the prediction coefficients and the error samples.

49. The method of claim 48, wherein reconstructing error samples from the codeword bits includes entropy decoding the codeword bits to produce error samples.

50. The method of claim 49, wherein the codeword bits are a combination of at least two terms, including a first term comprising a predetermined number of codeword bits, and a second term comprising a variable number of codeword bits, and wherein the number of codeword bits in the second term is generally greater for an error sample with large magnitude and generally smaller for an error sample with small magnitude.

51. The method of claim 50, wherein:

the number of codeword bits in the first term depends at least in part on the first code parameter; and the number of codeword bits in the second term depends at least in part on the second code parameter.

52. The method of claims 49 or 51 wherein reconstructing audio data using the prediction coefficients and the error samples includes:

dividing the error samples for a frame into one or more subsets, each subset containing at least one of the error samples for the frame;

computing a subset predictor for at least one of the subsets, wherein the subset predictor is computed using information from previous subsets; and reconstructing audio data using the first prediction coefficients, the subset predictor and the error samples.

53. The method of claim 52 wherein:

the audio data includes first audio data for a first audio channel and second audio data for a second audio channel; and reconstructing audio data includes reconstructing first audio data and then reconstructing second audio data using the first audio data.

54. A method of reconstructing audio samples, the audio samples divided into one or more frames and encoded by an audio coder, the method comprising:

obtaining codeword bits from an input stream, the input stream including side information;

obtaining side information from the input stream, and reconstructing first prediction coefficients using the side information;

reconstructing error samples for a frame from the codeword bits;

dividing the error samples for a frame into one or more subsets, each subset containing at least one of the error samples for the frame;

computing a subset predictor for at least one of the subsets, wherein the subset predictor is computed using information from previous subsets; and reconstructing audio samples using the first prediction coefficients, the subset predictor and the error samples.

55. The method of claim 54, wherein said reconstructing error samples for a frame from the codeword bits includes entropy decoding the codeword bits to produce error samples.

56. The method of claim 55 wherein:

the entropy decoding is characterized by at least one code parameter, and the code parameter determines a format of the codeword bits that are entropy decoded.

57. The method of claim 56 wherein the subset predictor comprises a first order linear predictor.

58. The method of claim 57 wherein the frame contains 1152 digital samples divided into 48 subsets that each contain 24 digital samples.

59. The method of claim 56 wherein a value of the code parameter is decoded from one or more code parameter bits contained in the side information.

60. The method of claim 59 wherein:

the audio samples includes first audio samples for a first audio channel and second audio samples for a second audio channel; and reconstructing the audio samples includes reconstructing the first audio samples and then reconstructing the second audio samples using the first audio samples.

* * * * *